US010487823B2

(12) United States Patent
Margolis et al.

(10) Patent No.: US 10,487,823 B2
(45) Date of Patent: Nov. 26, 2019

(54) FLUID FLOW NORMALIZER

(71) Applicants: LORD Corporation, Cary, NC (US); Donald L. Margolis, Elmacero, CA (US); Mark A. Norris, Cary, NC (US); Askari Badre-Alam, Cary, NC (US); Jonathan Owens, Chapel Hill, NC (US)

(72) Inventors: Donald L. Margolis, Elmacero, CA (US); Mark A. Norris, Cary, NC (US); Askari Badre-Alam, Cary, NC (US); Jonathan Owens, Chapel Hill, NC (US)

(73) Assignee: LORD Corporation, Cary, NC (US)

( * ) Notice: Subject to any disclaimer, the term of this patent is extended or adjusted under 35 U.S.C. 154(b) by 982 days.

(21) Appl. No.: 14/772,009

(22) PCT Filed: Mar. 13, 2014

(86) PCT No.: PCT/US2014/025698
§ 371 (c)(1),
(2) Date: Sep. 1, 2015

(87) PCT Pub. No.: WO2014/151420
PCT Pub. Date: Sep. 25, 2014

(65) Prior Publication Data

US 2016/0010638 A1 Jan. 14, 2016

Related U.S. Application Data

(60) Provisional application No. 61/786,836, filed on Mar. 15, 2013.

(51) Int. Cl.
*F04B 49/08* (2006.01)
*F04B 11/00* (2006.01)
(Continued)

(52) U.S. Cl.
CPC ..... *F04B 49/08* (2013.01); *E21B 21/00* (2013.01); *E21B 21/08* (2013.01); *F04B 11/00* (2013.01);
(Continued)

(58) Field of Classification Search
CPC ..... E21B 21/00; E21B 21/08; F04B 49/08; F04B 11/00; F04B 19/22; F04B 43/02; F04B 49/065; F04B 53/14; F04B 53/16
See application file for complete search history.

(56) References Cited

U.S. PATENT DOCUMENTS 4,299,253 A 11/1981 Burton
4,459,089 A 7/1984 Vincent et al.
(Continued)

FOREIGN PATENT DOCUMENTS

DE 4031239 4/1992
DE 19859186 6/2000
(Continued)

OTHER PUBLICATIONS

Collier, S.L., Know your triplex mud pump—6. pulsation dampeners improve performance, World Oil, 194:6, pp. 219-234 (Abstract).

*Primary Examiner* — Yong-Suk Ro

(57) ABSTRACT

A pumping system is provided. The pumping system includes an output conduit, a first sensor, a second second sensor, a feedforward active controller, and a fluid flow normalizer (FFN). The output conduit is associated with an output of a positive displacement pump. The first sensor is configured to measure a fluid flow characteristic (FFC) within the output conduit. The second sensor is configured to measure a phase of the positive displacement pump. The feedforward active controller is configured to receive information related to the FFC, receive information related to the phase of the positive displacement pump, and determine an FFC variability value. The first fluid flow normalizer (FFN)
(Continued)

is configured to at least one of add fluid to the output of the positive displacement pump and remove fluid from the output of the positive displacement pump in response to a signal from the feedforward active controller.

16 Claims, 10 Drawing Sheets

(51) Int. Cl.

| | |
|---|---|
| ***F04B 49/06*** | (2006.01) |
| ***E21B 21/00*** | (2006.01) |
| ***E21B 21/08*** | (2006.01) |
| ***F04B 19/22*** | (2006.01) |
| ***F04B 43/02*** | (2006.01) |
| ***F04B 53/14*** | (2006.01) |
| ***F04B 53/16*** | (2006.01) |

(52) U.S. Cl.
CPC ..... *F04B 19/22* (2013.01); *F04B 43/02* (2013.01); *F04B 49/065* (2013.01); *F04B 53/14* (2013.01); *F04B 53/16* (2013.01)

(56) References Cited

U.S. PATENT DOCUMENTS

| | | | | |
|---|---|---|---|---|
| 4,510,800 | A | 4/1985 | Prior | |
| 4,643,156 | A * | 2/1987 | Schatz ..... | F02B 29/0481 123/560 |
| 5,525,043 | A | 6/1996 | Lukich | |
| 6,742,534 | B2 | 6/2004 | Hogsden et al. | |
| 7,416,023 | B2 | 8/2008 | Krueger et al. | |
| 7,489,591 | B2 | 2/2009 | Mumby | |
| 2004/0016230 | A1 | 1/2004 | Hale | |
| 2005/0089428 | A1 | 4/2005 | Navarro | |
| 2008/0292483 | A1 | 11/2008 | De Koning | |
| 2012/0189477 | A1 | 7/2012 | Rogers | |

FOREIGN PATENT DOCUMENTS

| | | |
|---|---|---|
| DE | 10317910 | 11/2004 |
| EP | 0379718 | 8/1990 |
| GB | 2438955 | 12/2007 |
| RU | 2103547 | 1/1998 |

* cited by examiner

FLUID FLOW NORMALIZER

CROSS-REFERENCE TO RELATED APPLICATIONS

The present application claims priority to U.S. Provisional Patent Application No. 61/786,836 filed on Mar. 15, 2013 by Donald P. Margolis, et al., entitled "FLUID FLOW NORMALIZER," which is incorporated by reference herein as if reproduced in its entirety.

BACKGROUND

In some hydrocarbon recovery systems, a reciprocating pump may be used to deliver fluid into a wellbore. In some cases, the reciprocating pump may comprise a plurality of pistons driven by a shared crankshaft and each of the pistons may repeatedly displace a volume of fluid to a fluid output of the pump. While an average total output rate may be provided by the pump, the volumetric output associated with each of the pistons may generate a pressure pulsation within the fluid output and the fluid systems connected downstream relative to the fluid output. In some cases, the collection of pressure pulsations associated with the pistons may at least one of (1) coincide with at natural frequency and/or harmonic of a natural frequency of a component downstream of the fluid output, (2) reduce an effectiveness of a wellbore servicing method that is sensitive to pressure fluctuations, and (3) interfere with communications effectuated through the pumped fluid, such as, mud pulse telemetry. In some cases, pulsation dampers may be used to accommodate and/or dampen pressure pulsations by reactively expanding and/or compressing a compressible fluid in response to pressure pulsations. However, in some cases, the pulsation dampers are tuned and/or designed for a predetermined pressure and the pressure may not be easily adjustable in the field environment.

SUMMARY

In some embodiments of the disclosure, a pumping system is disclosed as comprising an output conduit associated with an output of a positive displacement pump, a first sensor configured to measure a fluid flow characteristic (FFC) within the output conduit a second sensor configured to measure a phase of the positive displacement pump; a feedforward active controller configured to receive information related to the FFC, receive information related to the phase of the positive displacement pump, and determine an FFC variability value, and a first fluid flow normalizer (FFN) configured to at least one of add fluid to the output of the positive displacement pump and remove fluid from the output of the positive displacement pump in response to a signal from the feedforward active controller.

In other embodiments of the disclosure, a hydrocarbon recovery system is disclosed as comprising a drillstring and a pumping system. The pumping system is disclosed as comprising an output conduit in fluid communication with the drillstring and associated with an output of a positive displacement pump, a first sensor configured to measure a fluid flow characteristic (FFC) within the output conduit, a second sensor configured to measure a phase of the positive displacement pump, a feedforward active controller configured to receive information related to the FFC, receive information related to the phase of the positive displacement pump, and determine an FFC variability value, and a first fluid flow normalizer (FFN) configured to at least one of add fluid to the output of the positive displacement pump and remove fluid from the output of the positive displacement pump in response to a signal from the feedforward active controller.

In yet other embodiments of the disclosure, a method of normalizing a fluid flow characteristic (FFC) of a fluid of an output of a positive displacement pump is disclosed as comprising determining an FFC variation of a fluid of an output of a first positive displacement pump, generating an FFC variation cancellation fluid output from a first fluid flow normalizer (FFN), and combining the output of the first positive displacement pump with the FFC variation cancellation fluid output of the FFN.

DETAILED DESCRIPTION

In some cases, it may be desirable to provide a fluid flow normalizer (FFN) for reducing an overall repetitive fluid flow variability of a pumping system. In some embodiments, the above-described FFN may be controlled to selectively reduce periodic increases in a fluid flow characteristic (FFC) of an output of a pumping system comprising a reciprocating and/or positive displacement pump by at least one of reducing a volumetric space of the fluid carrying components of the pumping system and increasing an amount of fluid injected into the fluid carrying components of the pumping system at appropriate intervals. In some embodiments, the above-described FFN may be controlled to selectively reduce periodic decreases in an output FFC of a pumping system comprising a reciprocating and/or positive displacement pump by at least one of increasing a volumetric space of the fluid carrying components of the pumping system and decreasing an amount of fluid injected into the fluid carrying components of the pumping system at appropriate intervals. In some embodiments, an FFN may be configured to selectively reduce a magnitude of both periodic increases and decreases in an output FFC of a pumping system comprising a reciprocating and/or positive displacement pump. In some embodiments, an FFN comprises a selectively controlled positive displacement fluid device, such as, but not limited to, a piston configured to inject fluid into the fluid carrying components of a pumping system and/or remove fluid from the fluid carrying components of a pumping system. In other embodiments, an FFN comprises a selectively controlled actuator configured to assist a flexible separation diaphragm of a fluid system damper. In some embodiments, the positive displacement fluid device (e.g., the piston) and/or the flexible separation diaphragm may be configured for exposure on opposing sides to be exposed to the static and/or average fluid pressure within the fluid carrying components of a pumping system, thereby enabling the FFN to achieve normalization while primarily performing work associated with the energy of the repetitive variations in FFCs, such as, but not limited to, fluid mass flow rates (FMFRs) and/or fluid pressures.

Figure 1:
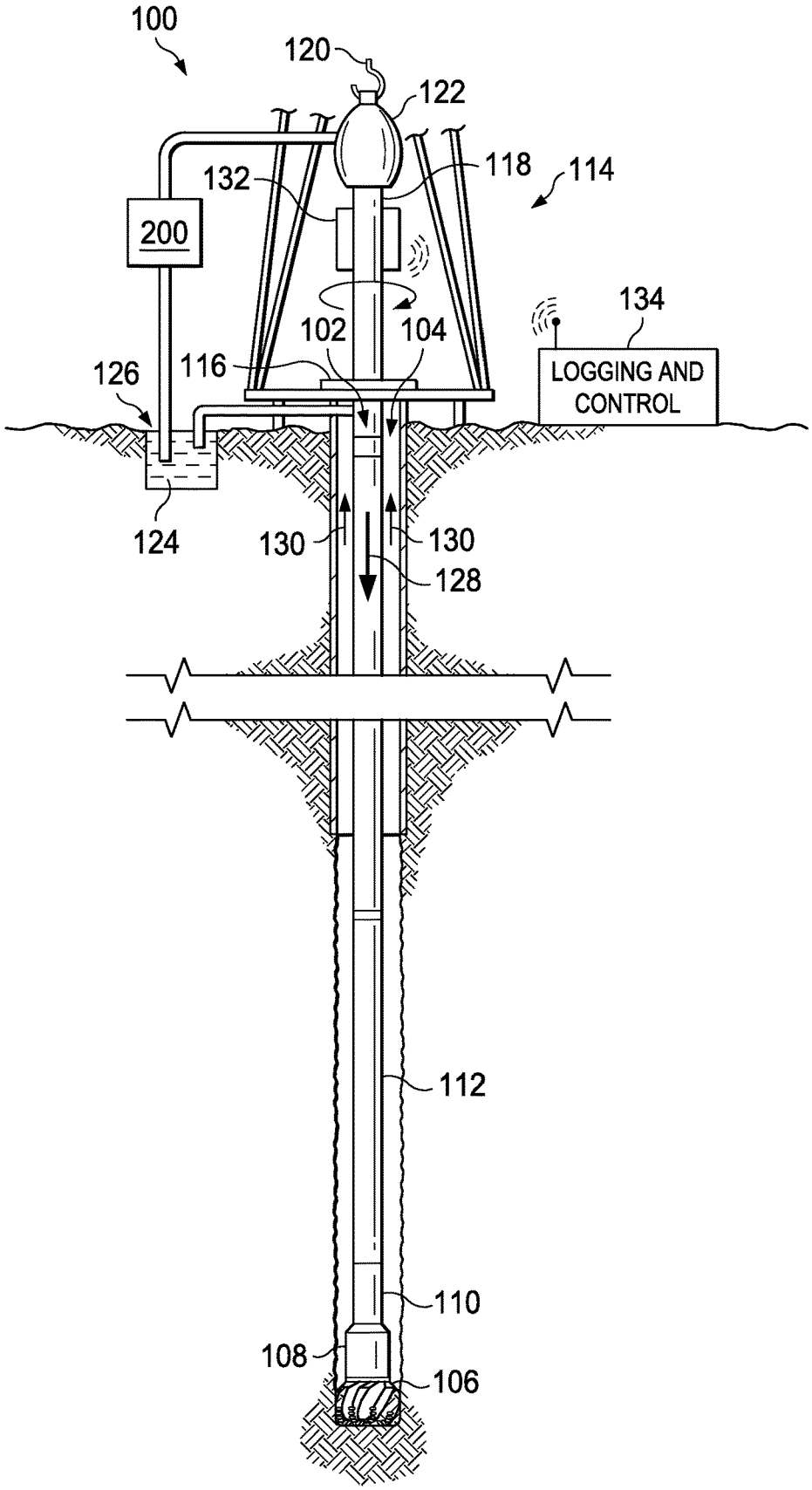
FIG. 1 is a schematic view of a hydrocarbon recovery system according to an embodiment of the disclosure.

Referring now to FIG. 1, a schematic view of a hydrocarbon recovery system 100 is shown. The hydrocarbon recovery system 100 may be onshore or offshore. They hydrocarbon recovery system 100 generally comprises a drillstring 102 suspended within a borehole 104. The drillstring 102 comprises a drill bit 106 at the lower end of the drillstring 102, a muleshoe or universal bottom hole orienting (UBHO) sub 108 connected above the drill bit 106, a spacer 110 connected above the UBHO sub 108, and electronic components 112. The hydrocarbon recovery system 100 comprises a platform and derrick assembly 114 positioned over the borehole 104 at the surface. The derrick assembly 114 comprises a rotary table 116 which engages a kelly 118 at an upper end of the drillstring 102 to impart rotation to the drillstring 102. The drillstring 102 is suspended from a hook 120 that is attached to a traveling block. The drillstring 102 is positioned through the kelly 118 and the rotary swivel 122 which permits rotation of the drillstring 102 relative to the hook 120. Additionally or alternatively, a top drive system may be used to impart rotation to the drillstring 102.

In some cases, the hydrocarbon recovery system 100 further comprises drilling fluid 124 which may comprise a water-based mud, an oil-based mud, a gaseous drilling fluid, water, gas and/or any other suitable fluid for maintaining bore pressure and/or removing cuttings from the area surrounding the drill bit 106. Some drilling fluid 124 may be stored in a pit 126 and a pumping system 200 may deliver the drilling fluid 124 to the interior of the drillstring 102 via a port in the rotary swivel 122, causing the drilling fluid 124 to flow downwardly through the drillstring 102 as indicated by directional arrow 128. The drilling fluid 124 may exit the drillstring 102 via ports in the drill bit 106 and circulate upwardly through the annulus region between the outside of the drillstring 102 and the wall of the borehole 104 as indicated by directional arrows 130. The drilling fluid 124 may lubricate the drill bit 106, carry cuttings from the formation up to the surface as it is returned to the pit 126 for recirculation, and create a mudcake layer (e.g., filter cake) on the walls of the borehole 104. In alternative embodiments, the hydrocarbon recovery system 100 may be configured to pressurize the borehole 104 for hydraulic fracturing the formations surrounding the borehole 104. In some methods of hydraulic fracturing, an effectiveness of the hydraulic fracturing technique may depend largely on a consistency in FFCs, such as, but not limited to, FMFRs and/or fluid pressures delivered to the formations.

The hydrocarbon recovery system 100 further comprises a communications relay 132 and a logging and control processor 134. The communications relay 132 may receive information and/or data from sensors, transmitters, and/or receivers located within the electronic components 112 and/or other communicating devices. The information may be received by the communications relay 132 via a wired communication path through the drillstring 102 and/or via a wireless communication path. The communications relay 132 may transmit the received information and/or data to the logging and control processor 134 and the communications relay 132 may receive data and/or information from the logging and control processor 134. Upon receiving the data and/or information, the communications relay 132 may forward the data and/or information to the appropriate sensor(s), transmitter(s), and/or receiver(s) of the electronic components 112 and/or other communicating devices. The electronic components 112 may comprise measuring while drilling (MWD) and/or logging while drilling (LWD) devices and the electronic components 112 may be provided in multiple tools or subs and/or a single tool and/or sub. In alternative embodiments, different conveyance types including, for example, coiled tubing, wireline, wired drill pipe, and/or any other suitable conveyance type may be utilized. In some embodiments, the above-described communications may comprise mud pulse telemetry in which the drilling fluid 124 and/or hydraulic fracturing fluids are used as a communication medium.

Figure 2:
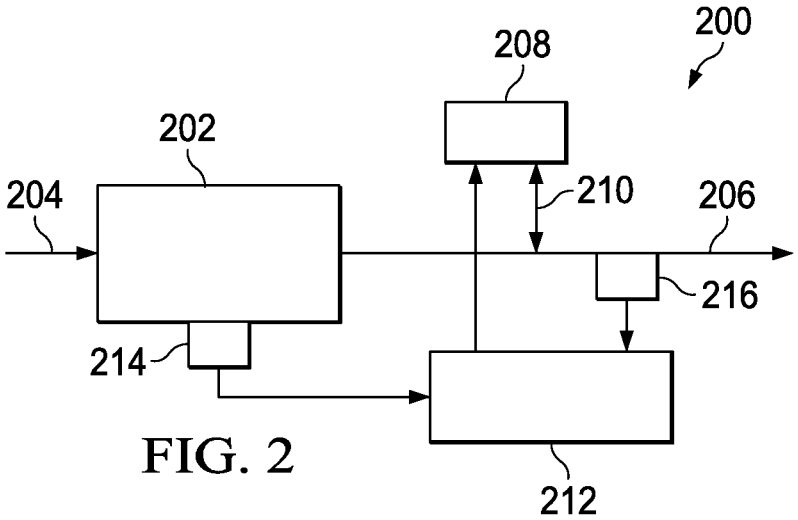
FIG. 2 is a schematic view of a pumping system of the hydrocarbon recovery system of FIG. 1.

Referring now to FIG. 2, a schematic of a pumping system 200 is shown. The pumping system 200 comprises a positive displacement pump 202, a pumping system fluid input 204, a pumping system fluid output 206, and a fluid flow normalizer (FFN) 208. The pump 202 comprises two sets of pistons. A first set of pistons comprises a first piston and a second piston while a second set of pistons comprises a third piston and a fourth piston. In alternative embodiments, the pump 202 may comprise any other number of pistons divided into any other number of sets and/or groups of pistons. In this embodiment, each piston is associated with a 4 inch bore, is configured to comprise an 8 inch stroke, and is configured for reciprocation of up to at least 180 strokes per minute. The pump 202 is configured to pump about 1.74 gallons per stroke which equals about 209 gallons per minute when operated at about 120 strokes per minute. While the pump 202 may comprise any suitable reciprocating and/or positive displacement pump comprising any number of pistons, sizes of pistons and bores, and range of speeds, the pump 202 may specifically be configured as a Quatro L1200HP Lightweight pump manufactured by White Star of Waller, Tex. The above pumping specifications are mentioned here as a convenient reference for use in explaining the operation of a particular and/or specific embodiment of the disclosure but this disclosure contemplates the use of the FFN 208 and related methods with any other reciprocating and/or positive displacement pump.

In some embodiments, the pumping system fluid output 206 may be referred to as a trunk line. The pumping system fluid output 206 is a common output conduit into which substantially all of the fluid displaced by the pistons is commonly driven by the pump 202. In other words, regardless of whether each piston and/or set of pistons comprises a dedicated output from the pump 202, all of the piston outputs and/or set of pistons outputs are in fluid communication with and feed fluid to the pumping system fluid output 206. The pumping system 200 further comprises a feedforward active controller (FAC) 212, a sensor 214 associated with the pump 202, and a sensor 216 associated with the pumping system fluid output 206. The sensor 214 is also referred to as a second sensor 214 and the sensor 216 is also referred to as a first sensor 216. The FAC 212 comprises a general purpose processor and/or a computer and the FFN 208 is in fluid communication with the pumping system fluid output 206 via a fluid tap conduit 210. The sensor 214 is configured to receive and/or report operational information regarding the operation of the pump 202, namely, a speed and/or phase of the pump 202. In this case, the sensor 214 comprises a tachometer configured to measure a speed of a common drive shaft of the pump 202 that powers movement of one or more of the pistons of the pump 202 via a substantially kinematically predicable mechanical linkage. In this case, signals generated by the FAC 212 as a function of shaft speed information provided to the FAC 212 by the sensor 214 are phase locked to the shaft speed. In this embodiment, the phrase "phase of the pump" is intended to reference a known location and/or motion characteristic of a piston of the pump 202. Phase locking to the shaft speed may track changes in a phase of the pump in part because of the substantially kinematically predictable mechanical linkage between the drive shaft and the pistons of the pump 202. As a result, the sensor enables the FAC 212 to track, predict, estimate, and/or otherwise utilize a phase of the pump 202. In some cases, the phase of the pump 202 may be a value that is directly related to a frequency of a piston of the pump. In alternative embodiments, the sensor 214 may comprise a hall effect sensor and/or any other suitable device for providing operational information regarding a phase of the pump 202 to the FAC 212. In cases where a hall effect sensor is utilized, the sensor 214 may substantially directly measure a phase of a piston and/or a phase of the pump 202. In some embodiments, tachometers and hall sensors, for example, are generally used to provide shaft rotational speed information and/or piston reciprocation frequency, respectively, and are phase-locked to the motion of the pump 202/piston assembly, as the pump 202 system is substantially kinematically predictable. The sensor 216 may comprise a pressure sensor, a mass flow sensor, a velocity sensor, and/or any other suitable device for sensing and/or reporting information to the FAC 212 about a FFC of the fluid within the pumping system fluid output 206, namely, FMFR, fluid pressure, and/or associated noise information. The FAC 212 is generally configured to receive the information from the sensors 214, 216 and output a control signal to FFN 208. The control signal may be amplified and may control and/or vary the operation of the FFN 208 to normalize a FFC of fluid of the pumping system fluid output 206 to at least one of (1) decrease a variability in the FFC, (2) decrease noise transmitted via the drilling fluid 124, and (3) decrease vibrational energy of a component of the pumping system 200 and/or a component attached to the pumping system 200 (e.g., a hose). In some embodiments, the FAC 212 may operate substantially similarly to one or more of the feedforward active control systems known to those skilled in the art. In short, the FAC 212 is configured to (1) determine and synchronize with an operational phase of the pump 202 as a function of the known and/or modeled physical characteristics of the pump 202 and the information received from the sensor 214 that is associated with the pump 202, (2) determine, calculate, and/or receive FFC information, such as, but not limited to, pressure information and/or FMFR information regarding the fluid of the pumping system fluid output 206, and (3) send control signals to the FFN 208 to operate the FFN 208 synchronously with the pump 202 to alter at least one FFC of the fluid of the pumping system fluid output 206.

Figure 3:
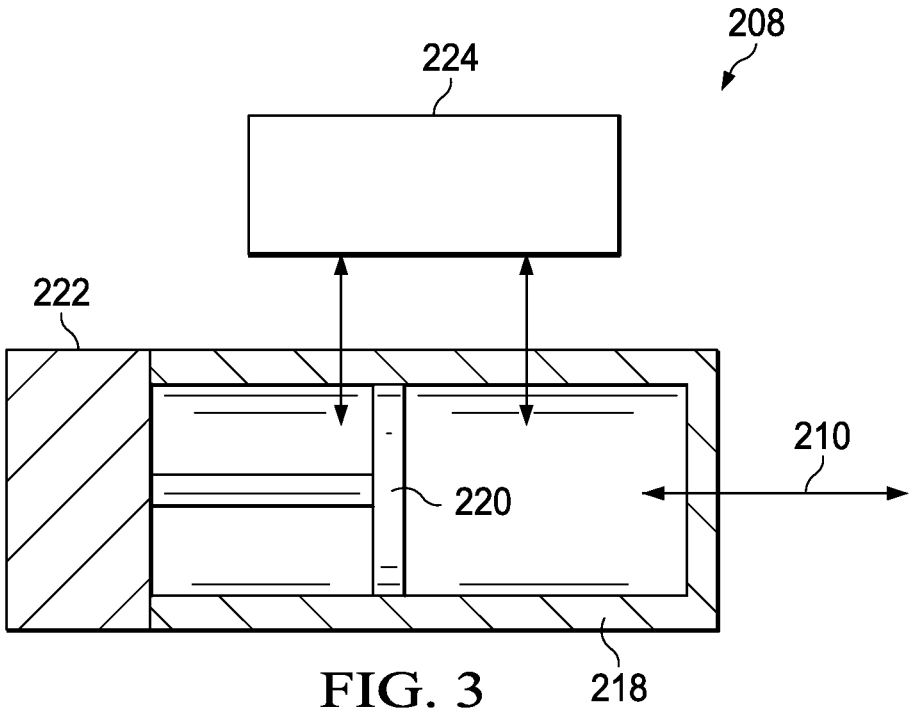
FIG. 3 is a schematic view of a fluid flow normalizer of FIG. 2.

Referring now to FIG. 3, a schematic of the FFN 208 is shown. The FFN 208 comprises a cylinder 218, a piston 220, and a drive unit 222 configured to selectively reciprocate the piston 220 within the cylinder 218. The FFN 208 further comprises an accumulator 224 joined in fluid communication with the cylinder 218 on both opposing axial sides of the piston 220 and the distal end of the cylinder 218 is in fluid communication with the pumping system fluid output 206 via the fluid tap conduit 210. In this embodiment, the fluid paths between the pumping system fluid output 206 and the portion of the cylinder between the piston 220 and the drive unit 222 may be relatively small in diameter and/or cross-sectional area so that only an average or substantially constant pressure of the fluid in the pumping system fluid output 206 is transmitted to the portion of the cylinder between the piston 220 and the drive unit 222 without also transmitting all of the transient pressure differentials and/or variable pressure waves. The above method of connecting a back side of a piston to a downstream pressure may be referred to as fluid decoupling and effectively allows the drive unit 222 to move the piston 220 by primarily overcoming the transient pressure differentials and/or variable pressure waves as opposed to the combined forces of the transient differentials and/or variable pressure waves plus the average or substantially constant pressure of the fluid in the pumping system fluid output 206. As such, in some embodiments, a drive unit 222 may comprise a much smaller capacity electrical motor and/or other powered device as a result of the fluid decoupling. The drive unit 222 may comprise an electronically controlled variable speed electric motor comprising an onboard motor control system configured to receive control signals from the FAC 212.

In operation, the pumping system 200 may operate to actively monitor, regulate, and/or normalize a FFC of the fluid within the pumping system fluid output 206.

Figure 4A:
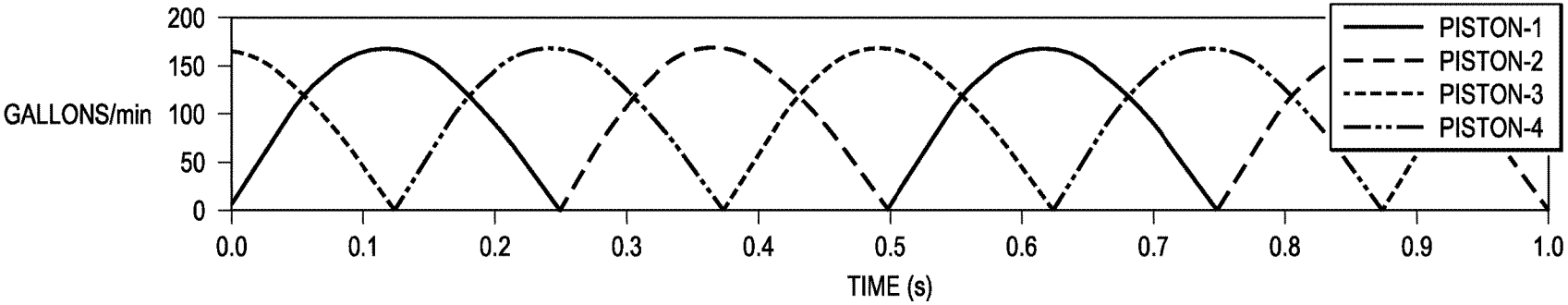
FIGS. 4A-4C are charts of the volumetric output of four pistons of a pump of the pumping system of FIG. 2, two piston sets of the pump of the pumping system of FIG. 2, and the pump of the pumping system of FIG. 2 as a whole relative to time, respectively.
Figure 4B:
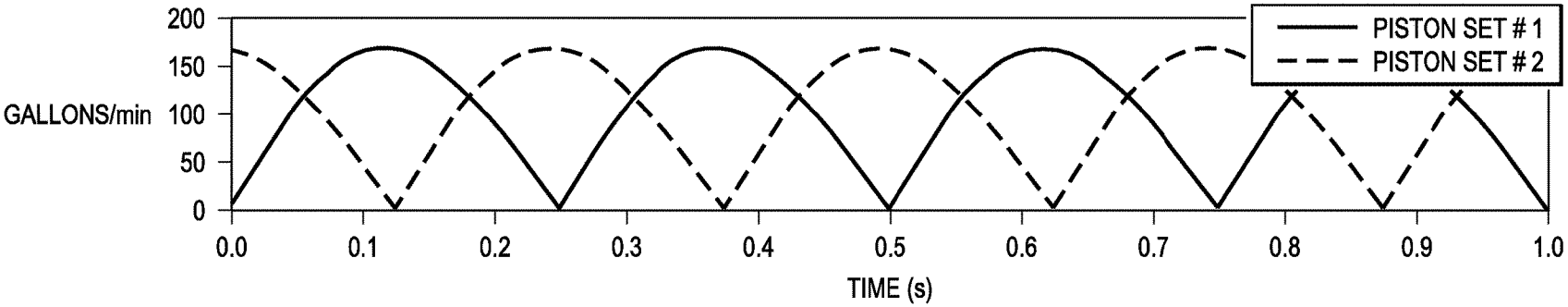
Figure 4C:
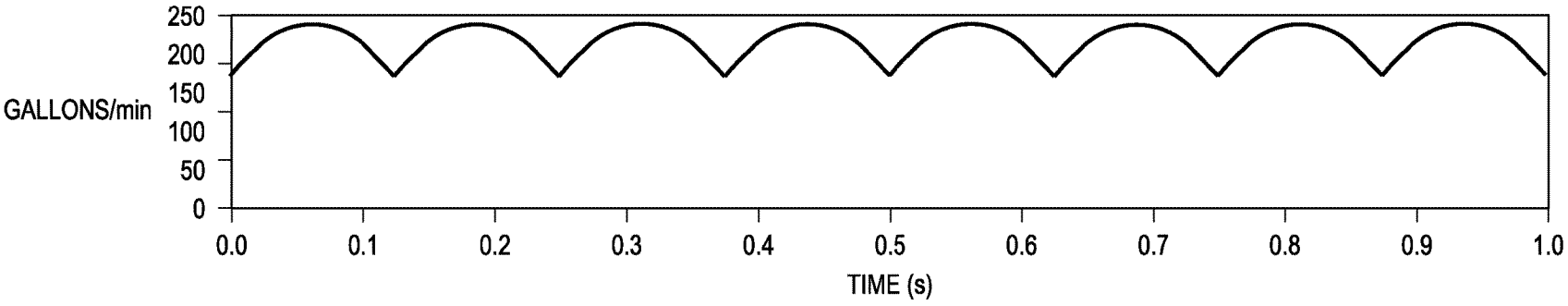

Referring now to FIGS. 4A-4C, charts of the volumetric output of the four pistons of the pump 202, two piston sets of the pumps 202, and the pump 202 as a whole are shown relative to time, respectively. FIG. 4A shows that each piston generates a volumetric displacement relative to the other pistons so that a substantially constant frequency of piston displacements occurs. FIG. 4B when compared with FIG. 4A shows that while the individual pistons themselves may have periods of zero displacement, the displacement provided by each of the piston sets (i.e. the addition of the curves of the first and second pistons to generate the curve of the first piston set and the addition of the curves of the third and fourth pistons to generate the curve of the second piston set) are substantially similar to each, both never negative in value, and out of phase with each other. FIG. 4C shows that the addition of the curves of the first and second piston sets of FIG. 4B results in a constantly positive but variable FMFR for the pump 202.

Figure 5A:
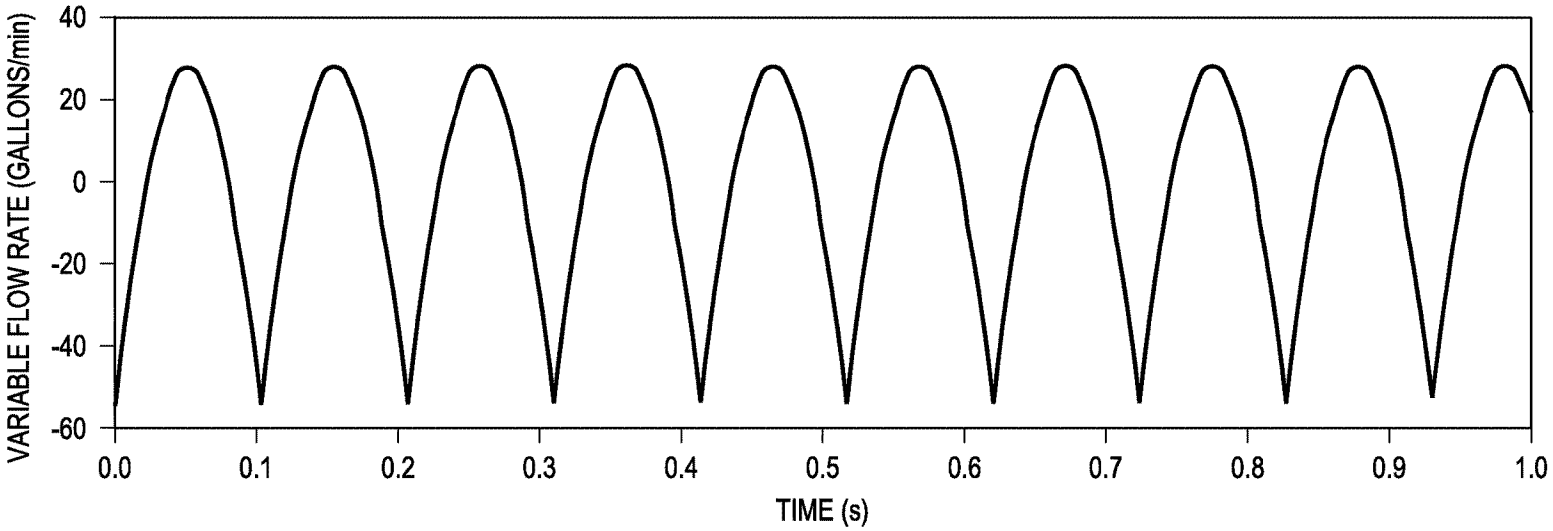
FIGS. 5A and 5B are charts of only the variable portion of the fluid mass flow rate of a fluid output from the pump of the pumping system of FIG. 2 and the charts show the variable portion of the fluid mass flow rate in flow rate and displacement volume, respectively, versus time.
Figure 5B:
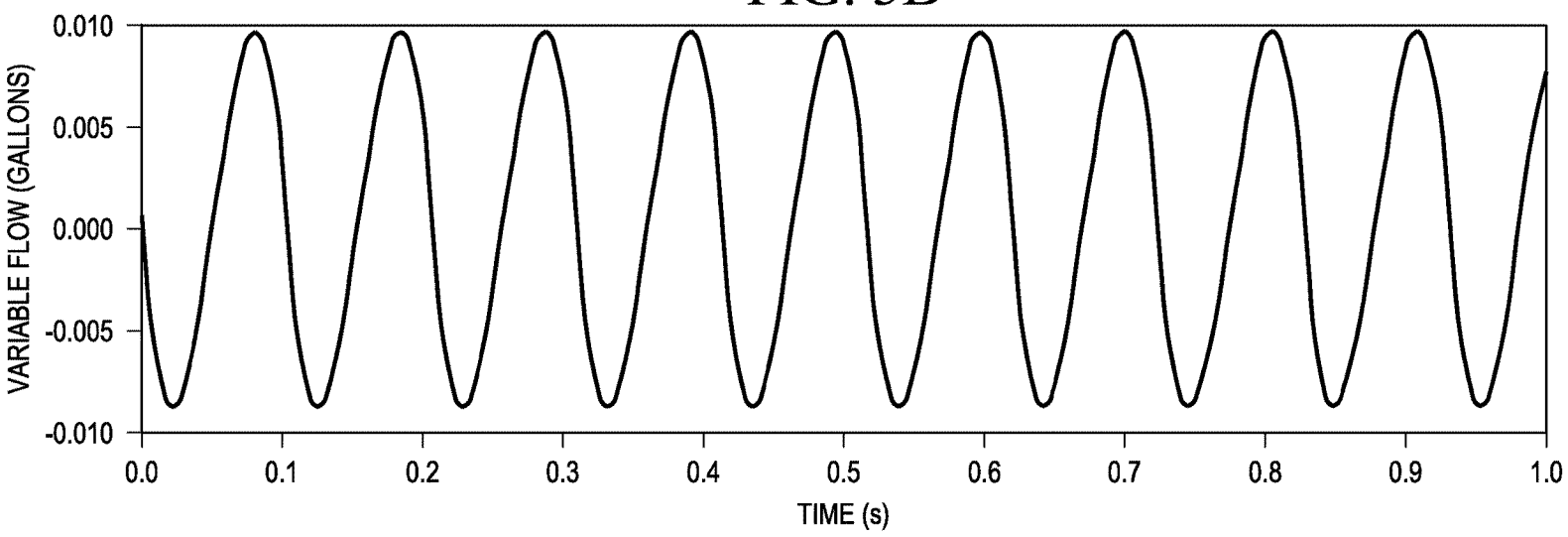

Referring now to FIGS. 5A and 5B, charts of only the variable portion of the FMFR of the fluid output from the pump 202 show the variable portion of the FMFR in flow rate and displacement volume, respectively, versus time.

Figure 6A:
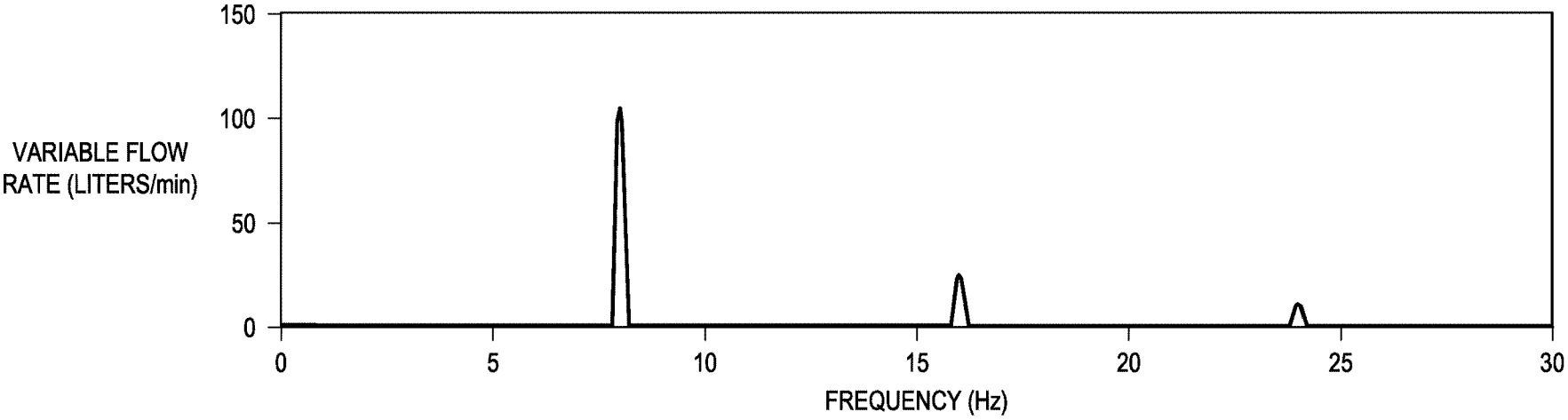
FIGS. 6A and 6B are charts of only the variable portion of the fluid mass flow rate of the fluid output from the pump of the pumping system of FIG. 2 and the charts show the variable portion of the fluid mass flow rate in flow rate and displacement volume, respectively, versus frequency.
Figure 6B:
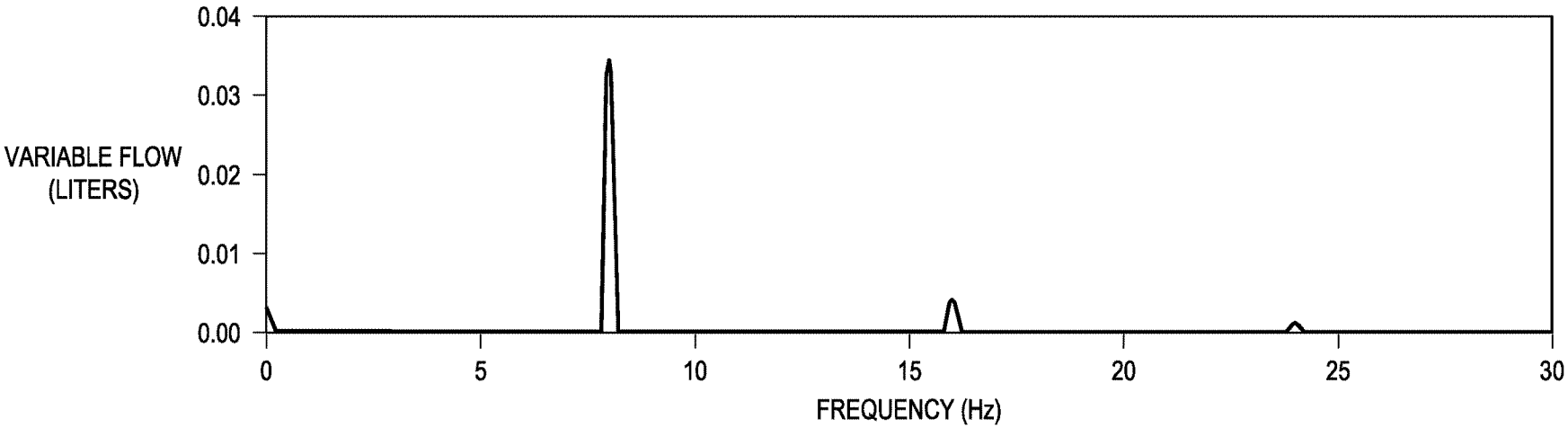

Referring now to FIGS. 6A and 6B, charts of only the variable portion of the FMFR of the fluid output from the pump 202 show the variable portion of the FMFR in flow rate and displacement volume, respectively, versus frequency.

Figure 7A:
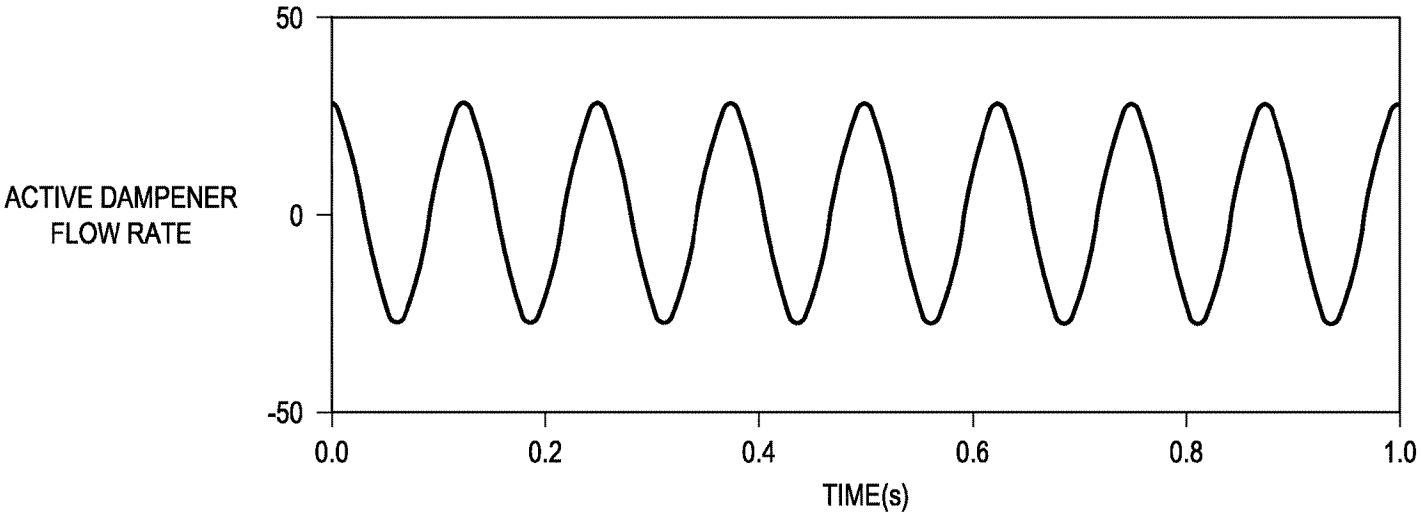
FIGS. 7A and 7B are charts of only the fluid mass flow rate of a fluid output of a fluid flow normalizer of FIG. 2 versus time and frequency, respectively.
Figure 7B:
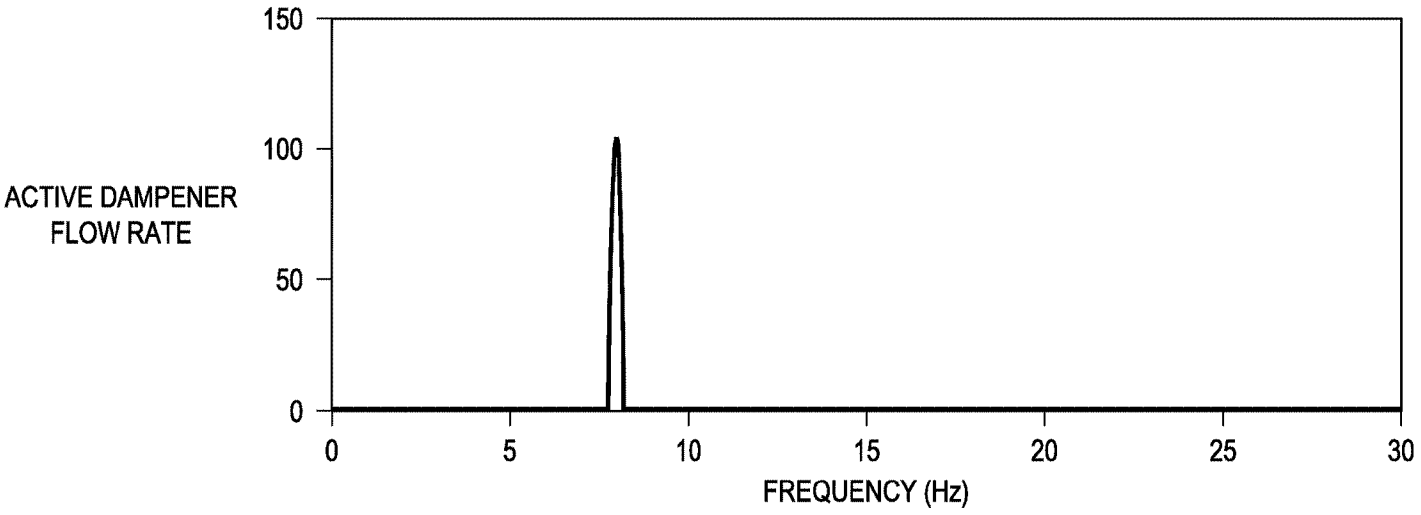

Referring now to FIGS. 7A and 7B, charts of only the FFN 208 fluid output FMFR versus time and frequency are shown, respectively.

Figure 8A:
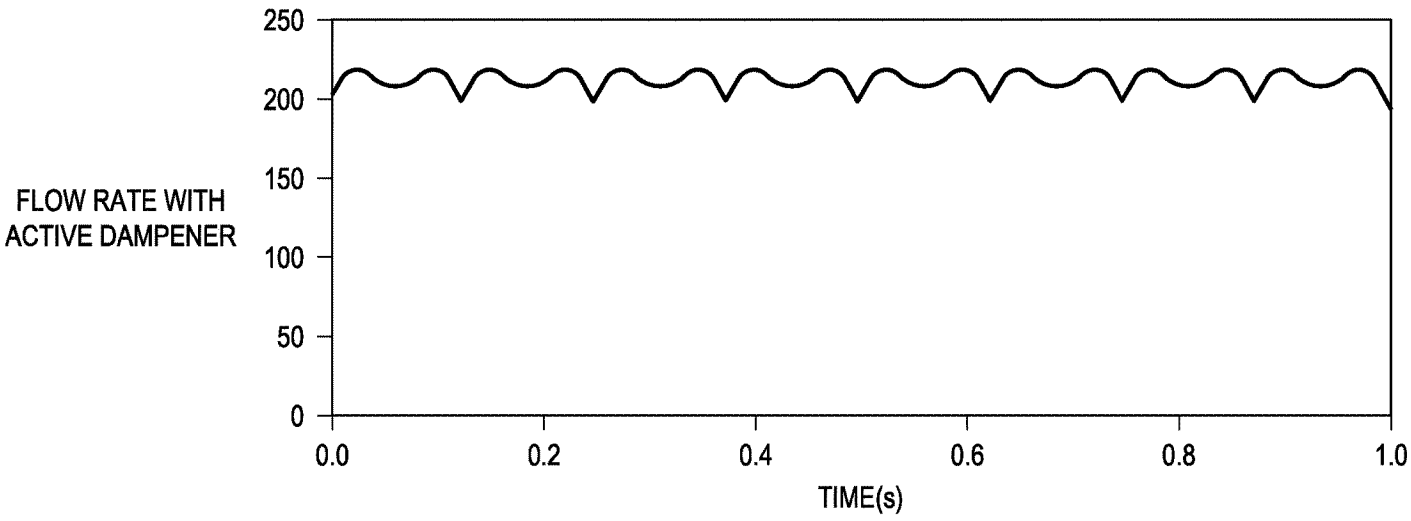
FIGS. 8A and 8B are charts of the fluid mass flow rate of the fluid output of the pumping system of FIG. 2 when both the pump and the fluid flow normalizer of FIG. 2 are operated, and the charts show the fluid mass flow rate of the fluid output of the pumping system of FIG. 2 versus time and frequency, respectively.
Figure 8B:
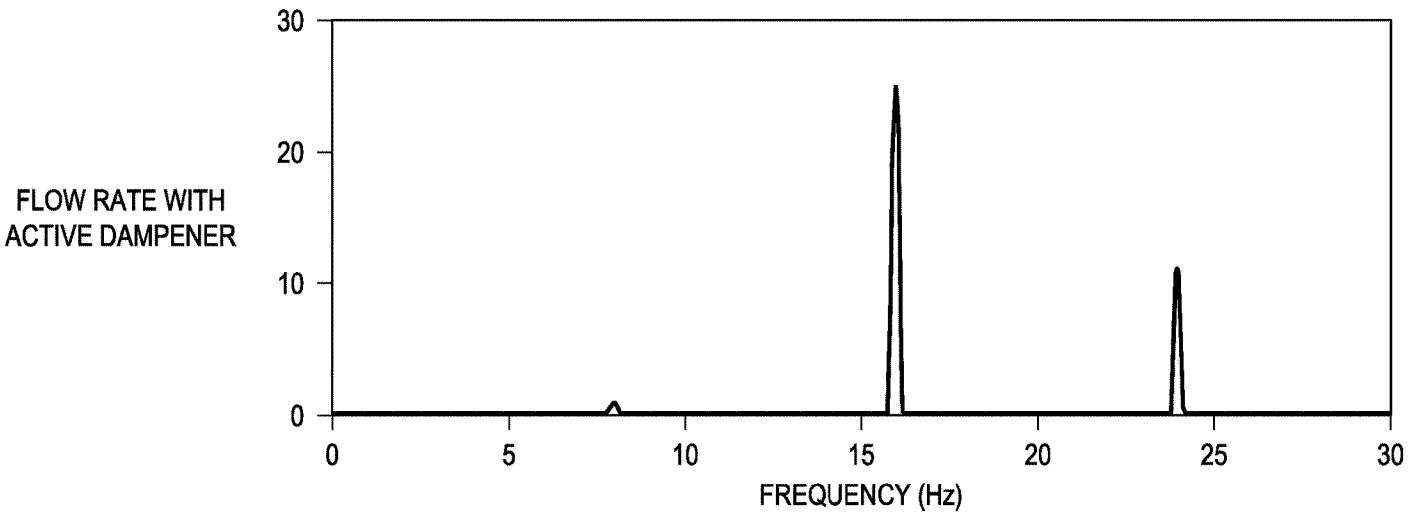

Referring now to FIGS. 8A and 8B, charts of the FMFR of the fluid of the pumping system fluid output 206 when both the pump 202 and the FFN 208 are operated are show versus time and frequency, respectively. FIG. 8A, when compared to FIG. 4C, shows that the operation of the FFN 208 simultaneously with the pump 202 operates to reduce a variability envelope of the FMFR of the fluid of the pumping system fluid output 206 when FFN 208 is suitably controlled by FAC 212. In other words, FIG. 8A represents the addition of the curve of FIG. 7A with the curve of FIG. 4C and the curve of FIG. 8A shows a smaller variable flow rate range as compared to the variable flow rate range of FIG. 4C. Accordingly, operation of the FFN 208 may be referred to as normalizing an FFC, namely the FMFR, of the fluid of the pumping system fluid output 206 and/or reducing a variability of an FFC, namely the FMFR, the of the fluid of the pumping system fluid output 206.

Figure 9:
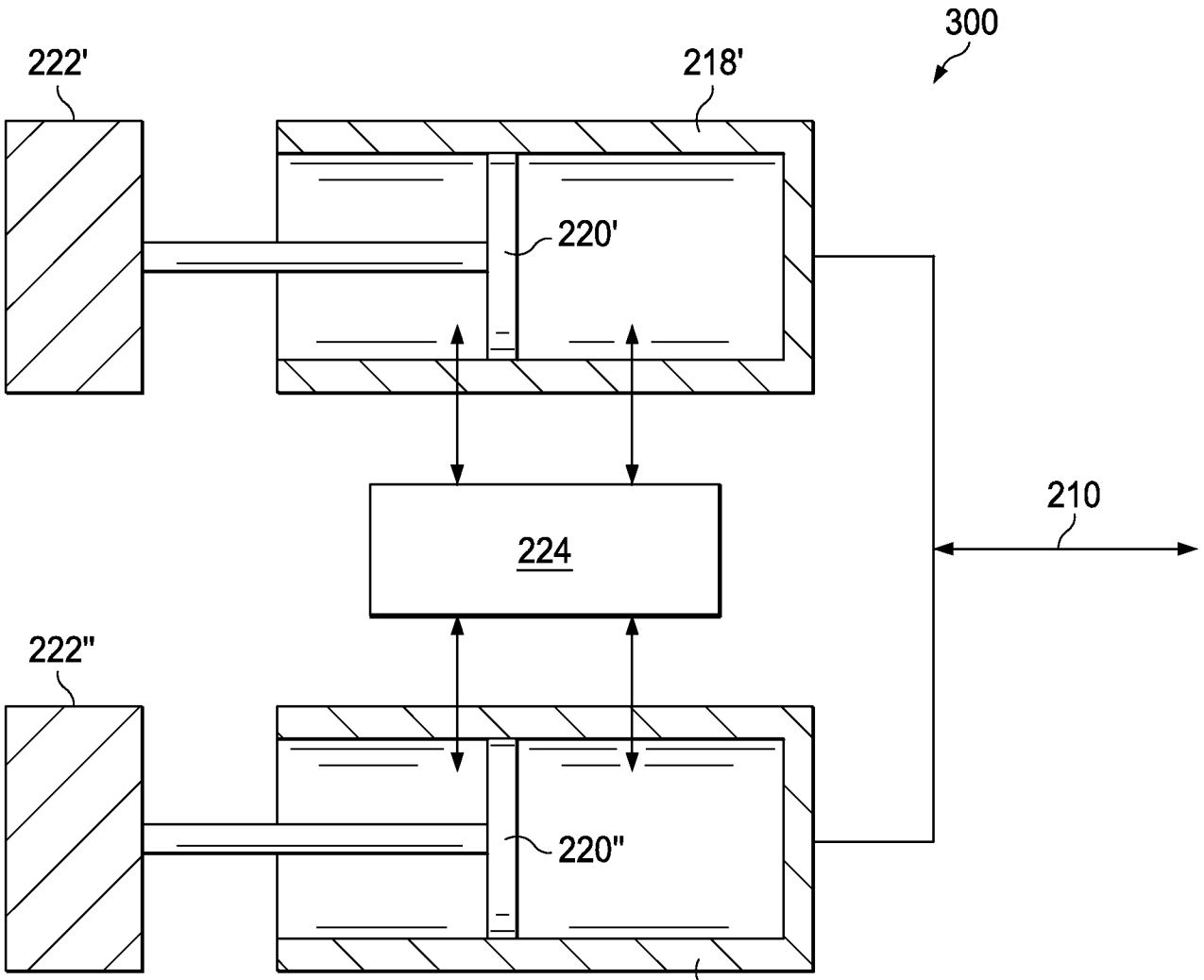
FIG. 9 is a schematic view of an embodiment of a fluid flow normalizer according to another embodiment of the disclosure.

Referring now to FIG. 9, a schematic view of an alternative embodiment of an FFN 300 is shown. In this embodiment, the FFN 300 is substantially similar to the FFN 208 but rather than comprising one cylinder 218, one piston 220, and one drive unit 222, the FFN 300 comprises two independently controllable drive units 222', 222" configured to selectively reciprocate two independently movable pistons 220', 220" within independent cylinders 218', 218". Because the two pistons 220', 220" may be independently control while their fluid outputs are joined together to feed the fluid tap conduit 210, FMFR and/or pressure of fluid supplied to the fluid tap conduit 210 may collectively be represented by curves of substantially any desired amplitude (within the total capacity of the FFN 300) and phase relative to a phase of the fluid output from the pump 202. By selectively controlling the phase of the pistons of the FFN 300 relative to each other, the FMFR output generated by the FFN 300 may complement and substantially cancel the selected undesirable FMFR pulses of the fluid output of the pump 202.

Figure 10:
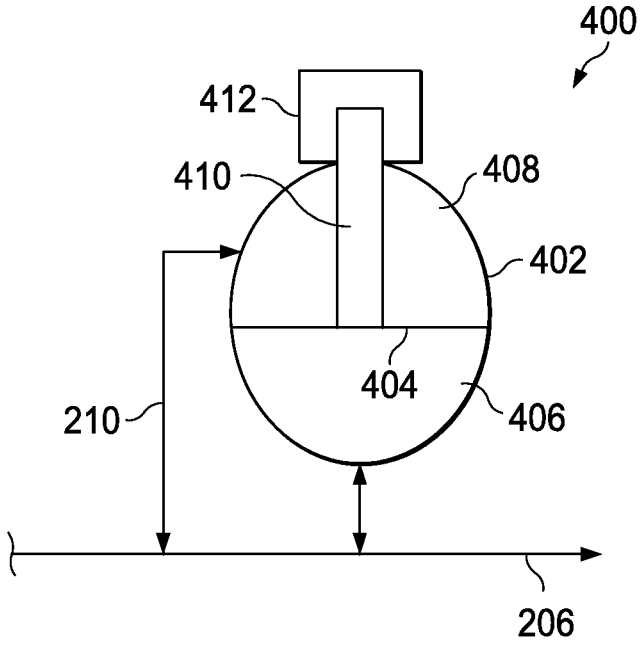
FIG. 10 is a schematic view of an embodiment of fluid flow normalizer according to still another embodiment of the disclosure.

Referring now to FIG. 10, a schematic view of an alternative embodiment of an FFN 400 is shown. In this embodiment, the FFN 400 is substantially similar to the FFN 208 but rather than a piston that reciprocates within a cylinder to displace fluid, the FFN 400 a reservoir 402 sealed by a diaphragm 404 to have a forward volume 406 and a rearward volume 408. The FFN 400 further comprises an actuator 410 connected to the diaphragm 404 and associated with a drive unit 412. The drive unit 412 is configured to be controlled in response to signals from the FAC 212 to selectively alter a fluid response characteristic of the diaphragm 404 to FFC variations (i.e. FMFR and/or pressure variations) of the fluid in the pumping system fluid output 206. The forward volume 406 of the reservoir 402 is in fluid communication with the pumping system fluid output 206 and, similar to the above-described fluid decoupling, rearward volume 408 of the reservoir 402 is also in fluid communication with the pumping system fluid output 206. Accordingly, the FAC 212 may be operated to control the drive unit 412 to move the actuator 410 thereby altering a location of the diaphragm 404 and either injecting or removing fluid from the pumping system fluid output 206. When controlled in accordance with the above-described methodologies, a variability of an FFC of the fluid in the pumping system fluid output 206 may be reduced and/or normalized. Further, in much the same way the FFN 300 utilizes two independent systems, an alternative embodiment of a FFN may comprise two reservoirs 402 each comprising independently movable diaphragms 404 so that both an amplitude and a phase of a combined output of the FFN may be controlled to further control normalization of the variability of the FFC of the fluid in the pumping system fluid output 206.

In alternative embodiments, any number and combination of FFNs disclosed above may be used together and controlled by FAC 212 to manage normalization of a FFC of a fluid of the pumping system fluid output 206. In some cases, one or more of the FFNs may be selectively disabled when not needed to achieve a normalization goal. Further, it will be appreciated that while the above-described FFNs are disclosed primarily as functioning to inject and/or displace fluid into the pumping system fluid output 206 to achieve normalization, in alternative embodiments, one or more of the FFNs may be configured to selectively remove fluid from the pumping system fluid output 206 to achieve normalization. In other words, the systems and methods disclosed and contemplated herein may equally achieve an FFC normalization goal by reducing FMFR and/or pressure pulse amplitudes rather than increasing rates of fluid injections during periods of low FMFR and/or pressure amplitudes. In some embodiments, pumping systems may comprise both injecting and evacuating type FFNs.

Figure 11:
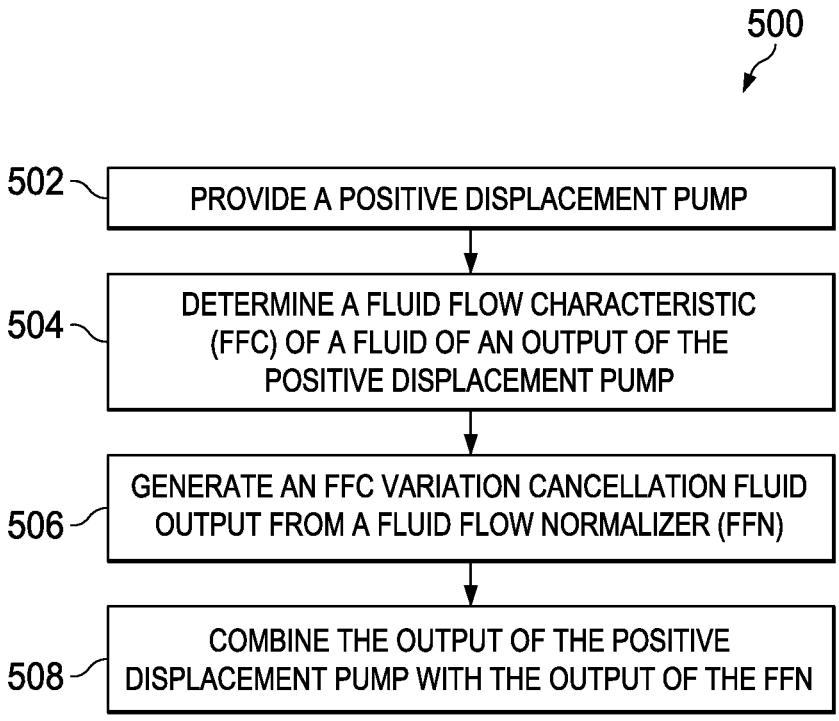
FIG. 11 is a flowchart of a method of normalizing a fluid flow characteristic of a fluid of a pumping system fluid output.

Referring now to FIG. 11, a flowchart of a method 500 of normalizing an FFC of a fluid of a pumping system output is shown. The method 500 may begin at block 502 by providing a positive displacement pump. The method 500 may continue at block 504 by determining an FFC variation of a fluid of an output of the positive displacement pump. The method 500 may continue at block 506 by generating an FFC variation cancellation fluid output from a FFN. The method 500 may continue at block 508 by combining the output of the positive displacement pump with the output of the FFN to promote normalization of the FFC. In some embodiments, the normalizing may not be a complete normalization and/or cancellation of variations of the FFC, but rather, may result in the selective removal of preselected pulses of particular frequencies, amplitudes, phases, and/or any other criteria and/or combination of criteria.

Figure 12:
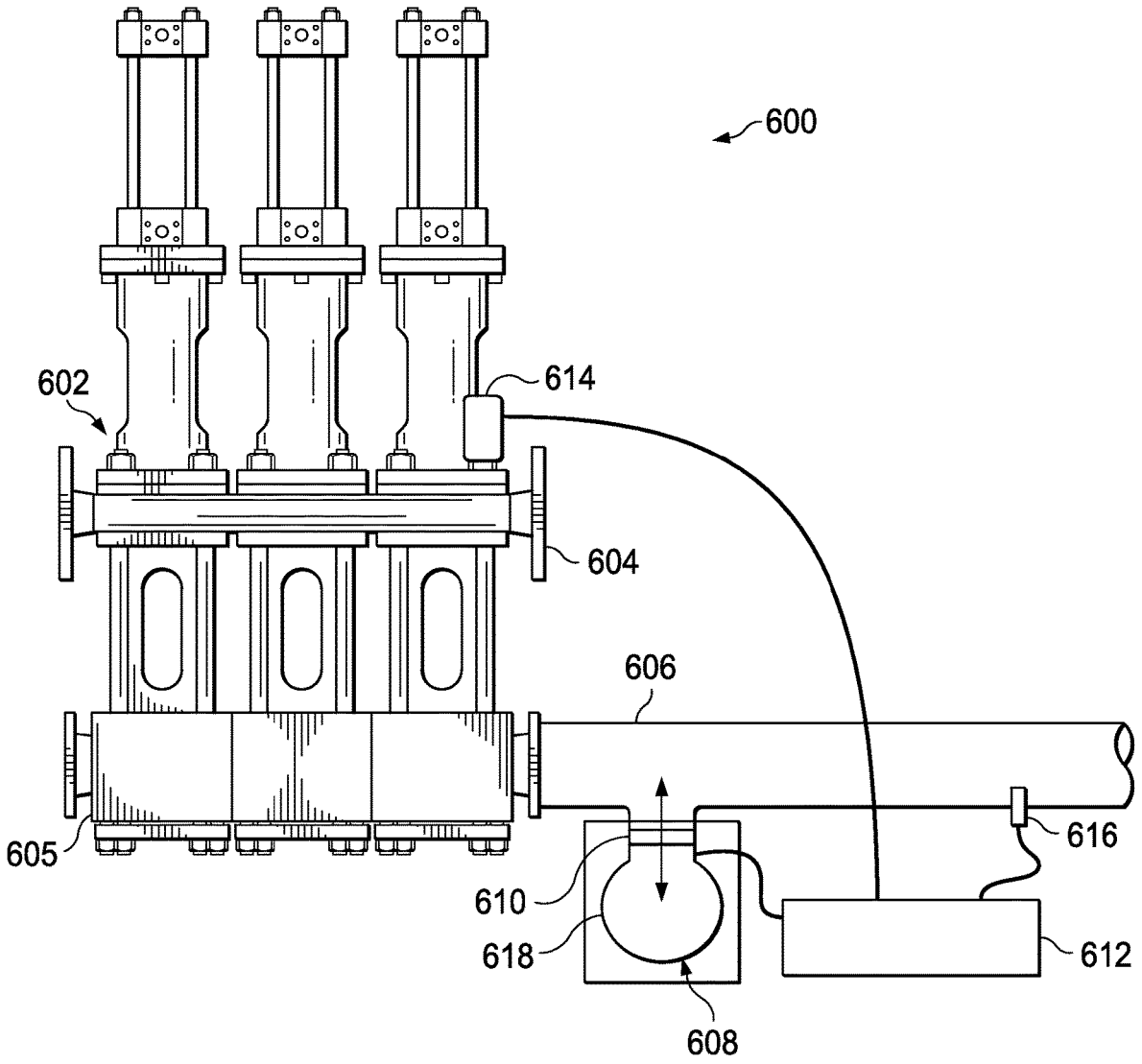
FIG. 12 is a schematic view of a pumping system according to another embodiment of the disclosure.

Referring now to FIG. 12, a schematic of a pumping system 600 according to an alternative embodiment of the disclosure is shown. The pumping system 600 comprises a positive displacement pump 602, a pumping system fluid input 604, a pump output manifold 605, a pumping system fluid output 606, and a FFN 608. The pump 602 comprises three pistons. In alternative embodiments, the pump 602 may comprise any other number of pistons divided into any number of sets and/or groups of pistons. The pump 602 may comprise any suitable reciprocating and/or positive displacement pump comprising any number of pistons, sizes of pistons and bores, and range of speeds. The pumping system fluid output 606 may be referred to as a trunk line. The pumping system fluid output 606 is a common output conduit into which substantially all of the fluid displaced by the pistons is commonly driven to by the pump 602. In other words, regardless of whether each piston and/or set of pistons comprises a dedicated output from the pump 602, all of the piston outputs and/or set of pistons outputs are in fluid communication with and feed fluid to the pumping system fluid output 606. The pumping system 600 further comprises a feedforward active controller (FAC) 612 substantially similar to FAC 212, a sensor 614 associated with the pump 602, and a sensor 616 associated with the pumping system fluid output 606. The FAC 612 comprises a general purpose processor and/or a computer. The sensor 614 is configured to receive and/or report operational information regarding the operation of the pump 602, namely, a speed and/or phase of the pump 602. In this embodiment, the sensor 614 comprises a tachometer which provides operational information regarding the pump 602, namely pump 602 speed, to the FAC 612. In this embodiment, the sensor 616 comprises a pressure sensor that reports information to the FAC 612 about a pressure of the fluid within the pumping system fluid output 606.

The FAC 612 is generally configured to receive the information from the sensors 614, 616 and output a control signal to FFN 608. The control signal may control and/or vary the operation of the FFN 608 to normalize an FFC of the pumping system fluid output 606 to at least one of (1) decrease a variability in the FFC, (2) decrease noise transmitted via the drilling fluid, and (3) decrease vibrational energy of a component of the pumping system 600 and/or a component attached to the pumping system 600 (e.g., a hose). In short, the FAC 612 is configured to (1) determine and synchronize with an operational phase of the pump 602 as a function of the speed of the pump 602, (2) determine, calculate, and/or receive FFC information (i.e. pressure information and/or FMFR information) regarding the fluid of the pumping system fluid output 606, and (3) send control signals to the FFN 608 to operate the FFN 608 synchronously with the pump 602 to alter an FFC of the fluid within the pumping system fluid output 606. In this embodiment, the FFN 608 comprises an actuator 610 that is in fluid communication with the pumping system fluid output 606. The actuator 610 may comprise an electrically driven piezoelectric transducer configured to effectively increase and/or decrease a volume of the pumping system fluid output 606 and/or by adding and/or removing fluid from the pumping system fluid output 606 in response to a control signal from the FAC 612. In this embodiment, the fluid and/or volume changes are associated with inverse and/or accommodating fluid and/or volume changes within an associated fluid reservoir 618. In some embodiments, the fluid reservoir may be segregated from the fluid of the pumping system fluid output 606 by a membrane or other flexible barrier as with FFN 400. While the actuator 610 is attached to the pumping system fluid output 606, in alternative embodiments the actuator may be attached directly to the pump output manifold 605. The tachometer sensor 614 provides an indication of the pump speed or frequency and a primary noise frequency may be a multiple of three of a measured pump 602 speed because there are three pistons. The pressure transducer and/or pressure sensor 616 provides real-time data for the FAC 612 to allow the FAC 612 to determine the phasing and amplitude needed for sending to the actuator 610 to reduce noise and/or pressure variations generated by the pump 602.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A pumping system, comprising:

an output conduit associated with an output of a positive displacement pump;

a first sensor configured to measure a fluid flow characteristic (FFC) within the output conduit;

a second sensor configured to measure a phase of the positive displacement pump;

a feedforward active controller configured to receive information related to the FFC, receive information related to the phase of the positive displacement pump, and determine an FFC variability value; and a fluid flow normalizer (FFN) configured to at least one of add fluid to the output of the positive displacement pump and remove fluid from the output of the positive displacement pump in response to a signal from the feedforward active controller.

2. The pumping system of claim 1, wherein the FFN comprises a piston disposed within a cylinder wherein the movement of the piston within the cylinder at least one of adds fluid to the output of the positive displacement pump and removes fluid from the output of the positive displacement pump.

3. The pumping system of claim 2, wherein the opposing volumes of the cylinder adjacent the piston are pressurized to a static pressure of the output of the positive displacement pump.

4. The pumping system of claim 1, wherein the FFN comprises a diaphragm disposed within a reservoir wherein the movement of the diaphragm within the reservoir at least one of adds fluid to the output of the positive displacement pump and removes fluid from the output of the positive displacement pump.

5. The pumping system of claim 4, wherein the opposing volumes of the reservoir adjacent the diaphragm are pressurized to a static pressure of the output of the positive displacement pump.

6. The pumping system of claim 1, further comprising a second FFN substantially similar to the FFN.

7. The pumping system of claim 6, wherein the FFN and the second FFN are powered by a shared drive unit.

8. The pumping system of claim 6, wherein the FFN and the second FFN are powered by separate drive units.

9. A hydrocarbon recovery system, comprising:

a drillstring; and a pumping system, the pumping system comprising:

an output conduit in fluid communication with the drillstring and associated with an output of a positive displacement pump;

a first sensor configured to measure a fluid flow characteristic (FFC) within the output conduit;

a second sensor configured to measure a phase of the positive displacement pump;

a feedforward active controller configured to receive information related to the FFC, receive information related to the phase of the positive displacement pump, and determine an FFC variability value; and a fluid flow normalizer (FFN) configured to at least one of add fluid to the output of the positive displacement pump and remove fluid from the output of the positive displacement pump in response to a signal from the feedforward active controller.

10. The hydrocarbon recovery system of claim 9, wherein the FFN comprises a piston disposed within a cylinder wherein the movement of the piston within the cylinder at least one of adds fluid to the output of the positive displacement pump and removes fluid from the output of the positive displacement pump.

11. The hydrocarbon recovery system of claim 10, wherein the opposing volumes of the cylinder adjacent the piston are pressurized to a static pressure of the output of the positive displacement pump.

12. The hydrocarbon recovery system of claim 9, wherein the FFN comprises a diaphragm disposed within a reservoir wherein the movement of the diaphragm within the reservoir at least one of adds fluid to the output of the positive displacement pump and removes fluid from the output of the positive displacement pump.

13. The hydrocarbon recovery system of claim 12, wherein the opposing volumes of the reservoir adjacent the diaphragm are pressurized to a static pressure of the output of the positive displacement pump.

14. The hydrocarbon recovery system of claim 9, further comprising a second FFN substantially similar to the FFN.

15. The hydrocarbon recovery system of claim 14, wherein the FFN and the second FFN are powered by a shared drive unit.

16. The hydrocarbon recovery system of claim 14, wherein the FFN and the second FFN are powered by separate drive units.

* * * * *